United States Patent [19]

Archibald et al.

[11] Patent Number: 4,662,642

[45] Date of Patent: May 5, 1987

[54] ROPING DUMMY FOR PRACTICING ROPING OF CALVES

[76] Inventors: Rodrick A. Archibald; David R. Archibald, both of 2689 Plute Rd., Marysville, Calif. 95901

[21] Appl. No.: 843,290

[22] Filed: Mar. 24, 1986

[51] Int. Cl.[4] ..... A63B 69/00; A63K 3/00; A63H 11/10; F41J 9/00

[52] U.S. Cl. ..... 273/339; 273/359; 273/370

[58] Field of Search ..... 273/339, 338, 359, 360, 273/367, 368, 369, 370

[56] References Cited

U.S. PATENT DOCUMENTS

| | | | |
|---|---|---|---|
| 4,136,874 | 1/1979 | McCord | 273/339 |
| 4,266,779 | 5/1981 | English | 273/359 |
| 4,451,045 | 5/1984 | Fesmire | 273/338 |

*Primary Examiner*—William H. Grieb
*Attorney, Agent, or Firm*—Mark C. Jacobs

[57] ABSTRACT

A dummy for practicing roping including a pair of spaced elongated members adapted to move along a supporting surface, a pair of upright members connected to the forward ends, respectively, of the elongated members and terminating at an apex, an elongated bar connected to the apex of the upright members extending rearwardly therefrom and generally parallel to the elongated members and generally equally spaced therefrom but extending beyond the elongated members. A simulated cow's head is mounted at the apex, and a simulated rear cow portion is mounted at the terminal end of the bar and rotatable thereabout. A pair of interconnected spaced elliptically shaped wheels are mounted between said elongated members adjacent the upright members and rotably interconnected thereto, the point of connection of the wheels to each other being offset from the point of connection to the upright members. A link interconnects the wheels and the rear cow portion so that the rear cow portion moves back and forth when the dummy is towed along a supporting surface and the wheels rotate on the supporting surface, the forward end of the dummy moving up and down with respect to the supporting surface when the dummy is towed therealong.

13 Claims, 8 Drawing Figures

ROPING DUMMY FOR PRACTICING ROPING OF CALVES

BACKGROUND OF THE INVENTION

1. Field of the Invention

The invention relates to roping dummies, and, more particularly, to structures simulating calves to practice roping or lasooing of the same.

2. Description of the Prior Art

Practice dummies for practicing roping of cows or the like have been suggested in the past. Generally, such devices have not been found sufficient to simulate the up and down movement of the forward end of a cow and the back and forth movement of the rear end of a cow. Such prior art devices have proven expensive and cumbersome to use and not predictable enough in response to the roper to be used as a teaching aid.

SUMMARY OF THE INVENTION

It is an object of this invention to provide an improved simulated roping dummy.

It is a further object of this invention to provide such simulated roping dummy which simulates both the up and down front movement of a cow and the back and forth rear movement.

It is still another object of this invention to provide a simulated roping dummy which gives positive and predictable results so it can be used as a teaching aid.

These and other objects are preferably accomplished by providing a dummy for practicing roping including a pair of spaced elongated members adapted to move along a supporting surface, a pair of upright members connected to the forward ends, respectively, of the elongated members and terminating at an apex, an elongated bar connected to the apex of the upright members extending rearwardly therefrom and generally parallel to the elongated members and generally equally spaced therefrom but extending beyond the elongated members. A simulated cow's head is mounted at the apex, and a simulated rear cow portion is mounted at the terminal end of the bar and rotatable thereabout. A pair of interconnected spaced elliptically shaped wheels are mounted between said elongated members adjacent the upright members and rotatably interconnected thereto, the point of connection of the wheels to each other being offset from the point of connection to the upright members. A link interconnects the wheels and the rear cow portion so that the rear cow portion moves back and forth when the dummy is towed along a supporting surface and the wheels rotate on the supporting surface, the forward end of the dummy moving up and down with respect to the supporting surface when the dummy is towed therealong.

DESCRIPTION OF THE PREFERRED EMBODIMENT

Figure 1:
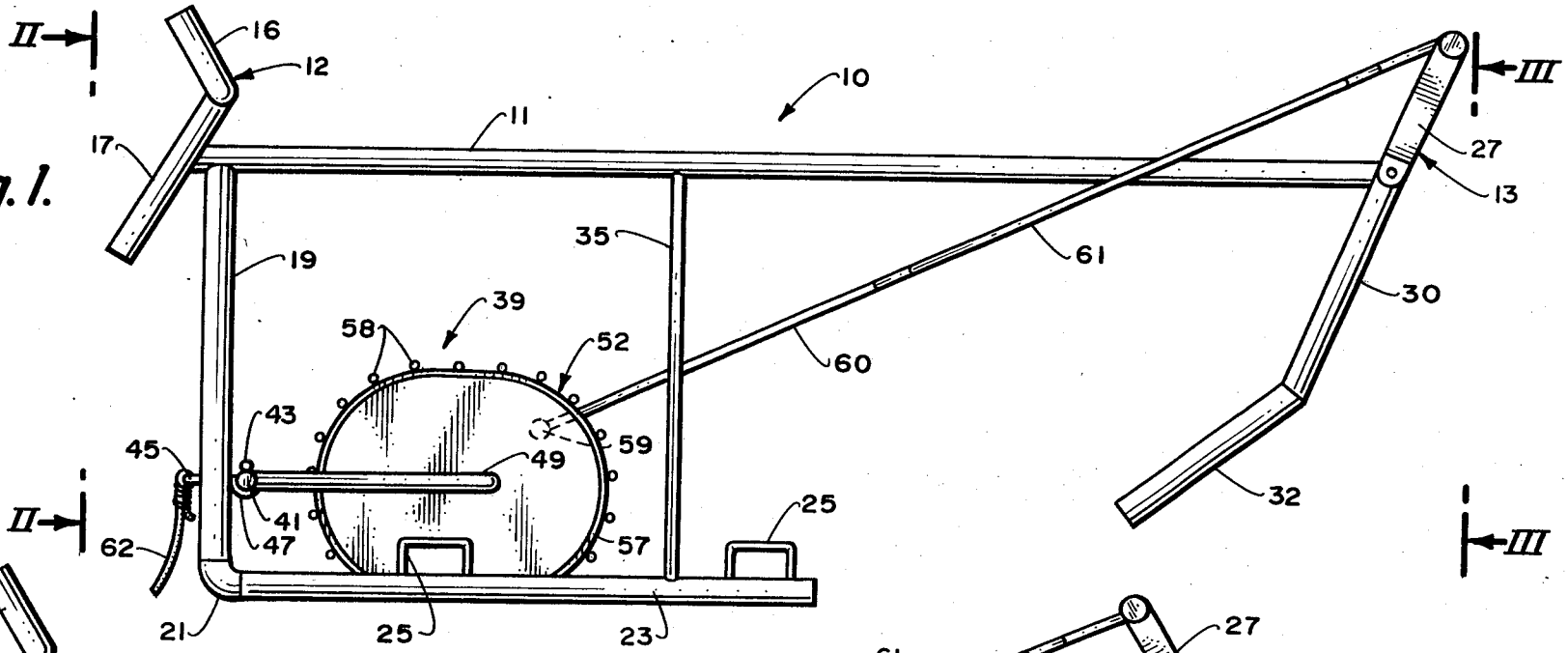
FIG. 1 is a vertical side view of a dummy in accordance with the teachings of the invention.

Referring now to FIG. 1 of the drawing, a dummy 10 is shown having an upper elongated tubular main rod 11, simulating the upper body portion of a calf, and a simulated head portion 12 at one end and a simulated rear portion 13 at the other end. Head portion 12 includes a cross-bar 14 (FIG. 2) welded or otherwise secured to rod 11, simulating the top of the head of a calf, and simulated horn portions 15, 16 extending from each end of cross-bar 14 and angularly and outwardly therefrom. A simulated head is provided in the form of a downwardly extending rod 17 which is also welded or otherwise secured to cross-bar 14, and, as seen in FIG. 1, extends downwardly at an angle and outwardly away from rod 11.

Figure 3:
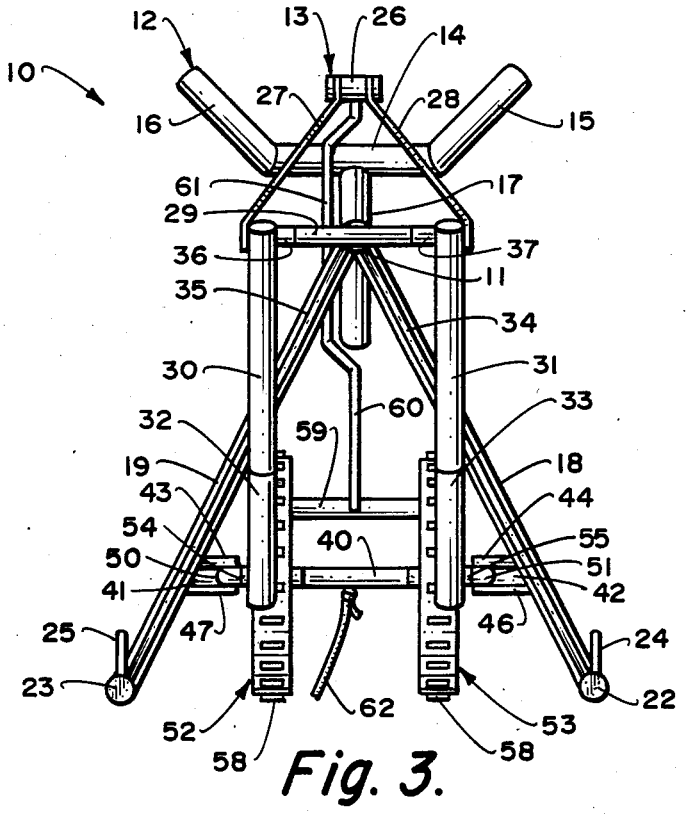
FIG. 3 is a view taken along lines III—III of FIG. 1.
Figure 4:
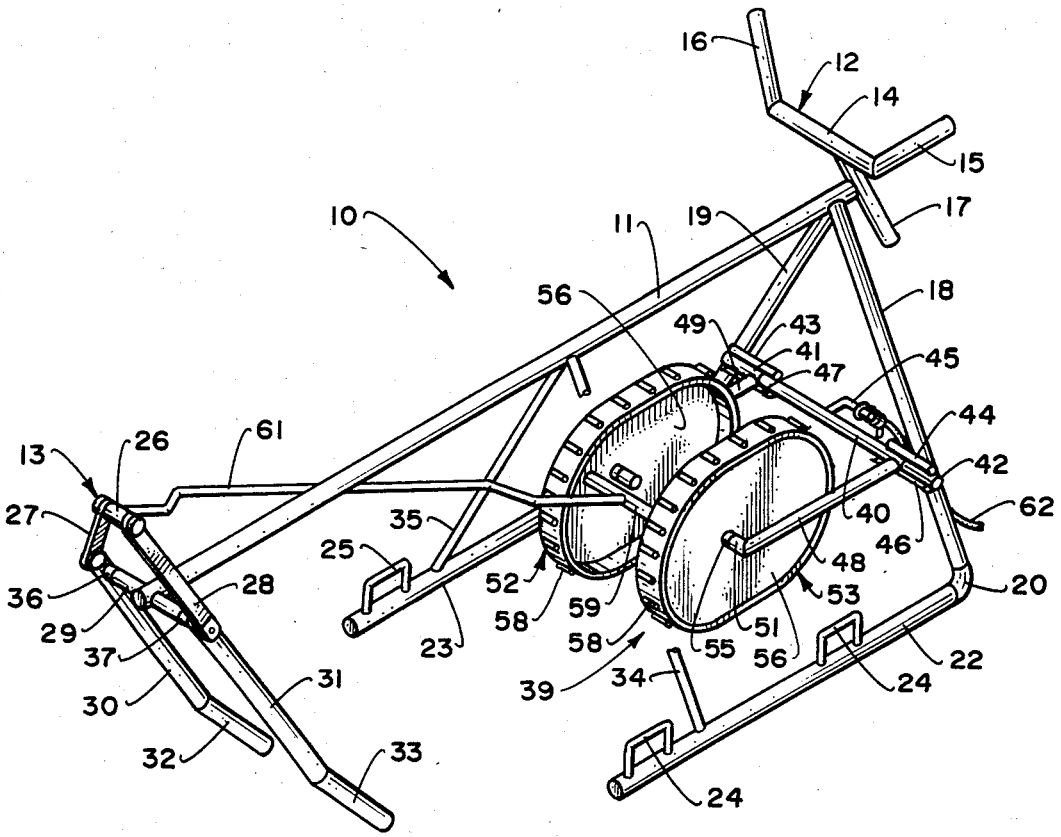
FIG. 4 is a rear perspective view of the dummy of FIGS. 1 to 3.

A pair of support bars 18,19 extend downwardly from rod 11, adjacent head portion 12, angled outwardly as seen in FIG. 4, and are also welded or otherwise secured to rod 11. Bars 18,19 are interconnected at their bottoms, via elbows 20,21, respectively, to a pair of elongated spaced base support rods 22,23, respectively. As seen in FIG. 4, each rod 22,23 has a hand hold 24,25 on its upper surface at the terminal end thereof. Also, as seen in FIG. 1, each rod 22,23 terminates at a point about half-way along the length of upper rod 11 for reasons to be discussed. Like hand holds 24,25 (see also FIG. 4) are provided on rods 22,23, respectively, at the midpoint thereof (see also FIGS. 3 and 4).

Rear portion 13 includes an upper cross bar 26 and a pair of downwardly extending flanges 27,28 secured to the ends of the bar 26 and extending outwardly therefrom. These flanges 27,28 may be secured to cross-bar 26 in any suitable manner, such as being welded thereto or journaled thereon, and extend to a cross-bar 29 welded or otherwise secured to the free end of upper rod 11. Cross-bar 29 is coupled to rods 30,31 by links 36,37, respectively (FIG. 4) pivotally interconnecting bar 29 to rods 30,31 so that the rear portion 13 is rotatable about the cross bar 29 as will be discussed further hereinbelow. Rods 30,31 extend downwardly terminating at their bottom ends in angled rods 32, 33, respectively.

Figure 2:
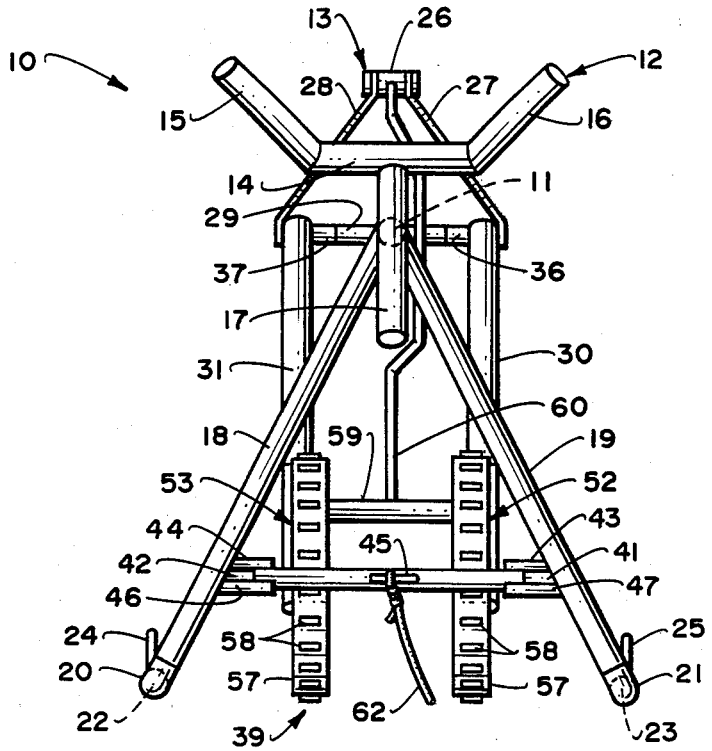
FIG. 2 is a view taken along lines II—II of FIG. 1.
Figure 5:
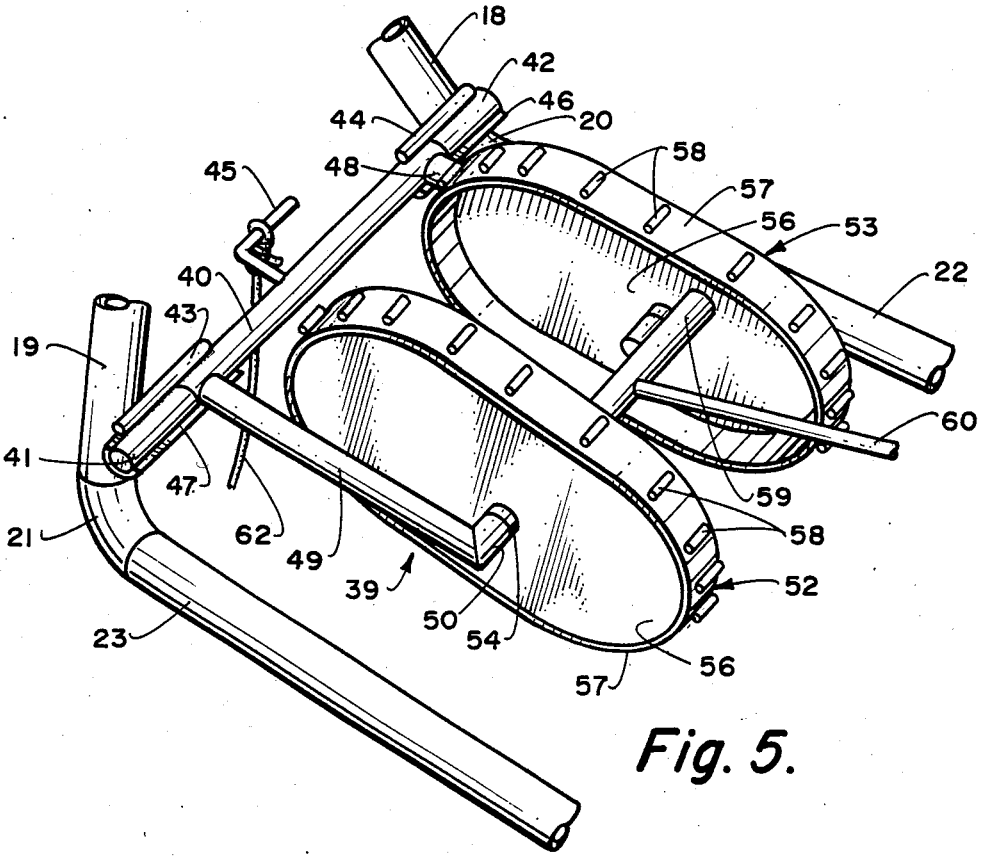
FIG. 5 is a perspective view of the lower front portion alone of the dummy of FIG. 1.
Figure 6:
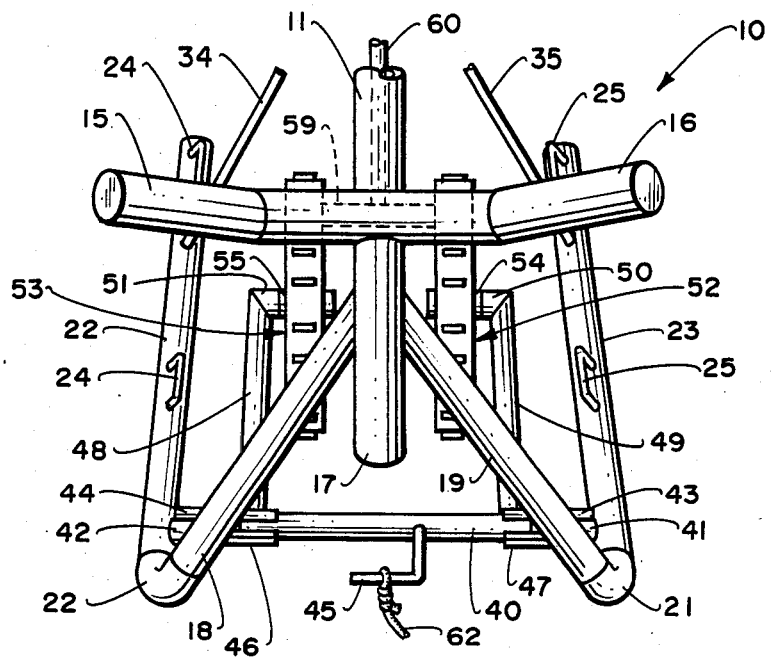
FIG. 6 is a top perspective view of the front end of the dummy of FIG. 1.

A pair of side braces 34,35 (see particularly FIG. 4) extend from rods 22,23, respectively, to top rod 11 and are welded or otherwise secured thereto. As seen in FIGS. 2 and 5, a wheel frame 39 is journalled for rotation on the front lower portion of dummy 10 (FIG. 5). Wheel frame 39 includes a first elongated member 40 having ends journalled in collars 41, 42 fixedly secured to the lower ends of bars 18,19, as by welding, with braces 43,44 overlying collars 41,42, respectively, welded or otherwise secured to member 40. An L-shaped tie rod 45 is welded or otherwise secured to member 40 at about the midpoint thereof. Additional support for collars 41,42 may be provided in the form of U-shaped flanges 46,47 (FIG. 6) underlying collars 41,42, respectively, welded or otherwise secured to rods 22,23, respectively.

A pair of elongated rods 48,49 (FIGS. 5 and 6) extend rearwardly from member 40 and are welded or otherwise secured thereto. Rods 48,49 terminate in collar portions 50,51 extending normal to rods 48,49, respectively, welded or otherwise secured thereto or an integral part thereof.

A pair of spaced elliptically shaped wheels 52,53 are mounted to rods 48,49. Wheels 52,53 have hubs 54,55 journalled on collar portions 50,51, respectively. As seen in FIG. 5, each wheel 52,53 is rather large in diameter having a main circular planar side wall 56 and a peripheral circular flange or ring 57 which rests on and moves over the supporting surface. Wall 56 may be a solid member with flange or ring 57 welded or otherwise secured thereto. A plurality of spaced raised lugs 58 are provided on the outer periphery of each ring or flange 57 to provide a thumping action. These lugs 58 may be secured to ring 57 and wall 56 by welding or the like and may in fact provide the means for joining ring 57 to wall 56.

A tubular axle 59 interconnects wheels 52,53 and is fixedly secured thereto, as by welding, at a location offset from the center of each wheel 52, 53 (see particularly FIGS. 1 and 5) as, for example, about 7 inches from the center thereof. An elongated rod 60 (FIG. 5) is welded at one end or otherwise secured to axle 59, at preferably the midpoint thereof, and extends upwardly and rearwardly to the intersection of flanges 27,28 (FIG. 1) where it is secured to cross bar 267 in any suitable manner, as by welding, As seen in FIG. 1, rod 60 has a bend or kink 61 therein for reasons to be discussed. In use of dummy 10, it can be dragged or pulled along a supporting surface by a rope 62 or the like tied to tie rod 45.

Figure 8:
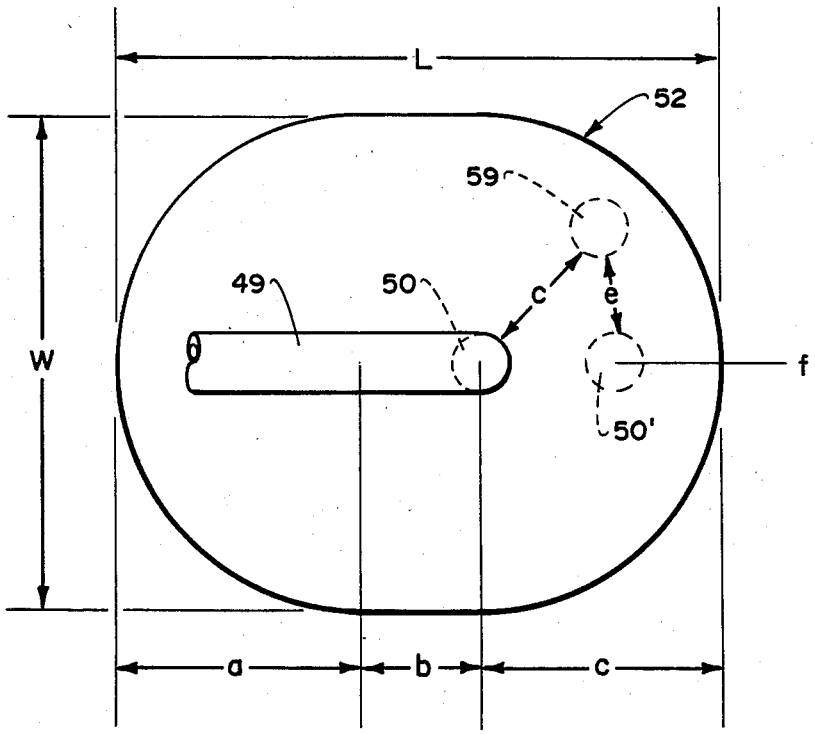
FIG. 8 is a vertical view of one of the wheels of the dummy of FIG. 1 with parts thereof ommitted for convenience of illustration.

The dummy 10 may be made of pipe sections or metal tubing welded or otherwise secured together, or of any suitable materials and dimensions. For example, rod 11 may be about 87 and one half inches in length, rods 22,23 may be about 40 inches in length, bars 18,19 may be about 28 inches in length, flanges 27,28 may be about 10 inches in length, rods 30,31 may be about 16 inches and rods 32,33 may be about 14 and one half inches in length. Rod 60 may be about 68 and one half inches from kink 61 to axle 59 and the bottom of bars 18,19 may be about 6 and one quarter inches to the connection of rods 48,49 to wheels 52,53. Side braces 34,35 may be about 30 and one half inches long and the distance between braces 34,35 and bars 18,19 may be about 30 and one half inches. The center of cross bars 14 may be about 4 inches from the upper surface of rod 11 and the head portion 12 may overhang about 1 inch (i.e., rod 11 may extend beyond bars 18,19 about 1 inch). Tubing of about 1 and ½ to 2 inches in diameter may be used throughout. The width of dummy 10 may be about 16 inches. Cross bar 14 may be about 12 inches in length with horn portions 15,16 about 7 inches long. As seen in FIG. 8, wheels 52 and 53 are identical; each wheel, such as wheel 52 may have a length L of about 20 inches and a width W of about 16 inches with the distances a and c about 8 inches. The distance b may be about 4 inches. Collar portions 50,51 lie on the radius c of the right portion of wheel 52 while axle 59 is offset therefrom a distance of about 7 inches. Axle 59 is also offset a distance e of about 4 inches from the dotted line position 50' (i.e., extending portion 50 along centerline f.)

Figure 7:
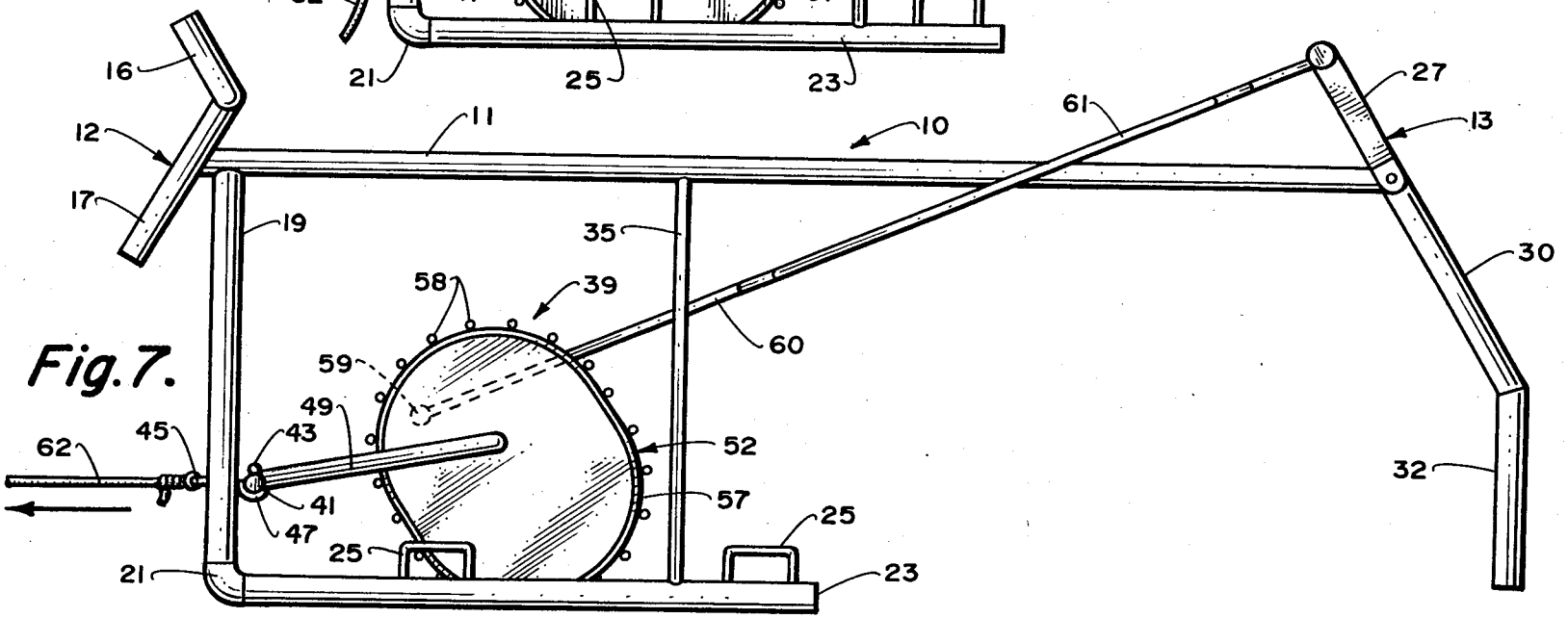
FIG. 7 is a side view of the dummy of FIG. 1 showing the rear portion thereof in one position.

In operation, rope 62 is attached to tie rod 45 of dummy 10 and dummy 10 is towed along a surface by a car, a lawnmower, or truck or any other suitable means. Wheels 52,53 roll along the ground or surface. As seen in FIG. 7, the rear portion 13 is in a first position angled rearwardly. As dummy 10 is towed and wheels 52,53 rotate, rod 60 pulls the top of rear portion 13 forwardly, one of the stages thereof being shown in FIG. 1. It is to be understood that rear portion 13 goes through a variety of positions progressing from the FIG. 7 position through the FIG. 1 position, and intermediate stages therebetween, and back to the FIG. 7 position. In this manner, the rear position 13 simulates the undulation of the rear of a calf while lugs 58 and the elliptical shape of the wheels simulate the bumping or erratic up and down movement of a calf. A roper can practice trying to lasso the dummy 10. This learning experience can be used on the range by the learner or even in rodeo competition, alone or with a team.

Welded bars of steel may be used throughout so dummy 10 won't corrode or wear out and requires little maintenance. Of course, any suitable materials, such as plastics, may be used. It gives a realistic action and can easily be transported and pulled at any desired speed. Obviously, it eliminates use of live calves and can be made of any desired colors or weight. The length of the various members may vary and may even be of adjustable telescoping sections, locked in position. The roper, either on horseback or on foot, must throw his lasso properly and with accuracy to lasso dummy 10. The elliptical shape of the wheels enables the lower front of dummy 10 to raise as in FIG. 1, then go back to engage the ground as in FIG. 7, with simultaneous back and forth movement of the rear portion due to the connecting link and bend therein, much in the manner of how an actual calf responds. The dummy 10 can be roped just as the simulated legs or rear portion 13 is coming back or starting forward which is the correct way to rope calves. The device has a more cow-like action than known prior art devices. Each time wheels 52,53 rotate one full revolution, the rear portion 13 goes from front to back while the front end goes up and back down. It can be used in all types of weather. The dummy herein lends itself to predictability of operation thus making it better for instruction than an actual cow. The spaced wheels 52,53 provide balance as well as weight and traction. With the arrangement disclosed herein, it takes about 2 and one half to 5 seconds for one complete rotation of wheels 52,53. Suitable bearings and fittings may be used throughout where necessary.

Since certain changes may be made in the above apparatus without departing from the scope of the invention herein involved, it is intended that all matter contained in the above discription and shown in the accompanying drawing shall be interpreted as illustrative and not in a limiting sense.

We claim:

1. A dummy for practicing roping comprising:

a pair of spaced elongated members adapted to move along a supporting surface;

a pair of upright members connected to the forward ends, respectively, of said elongated members and terminating at an apex;

an elongated bar connected to the apex of said upright members extending rearwardly therefrom and generally parallel to said elongated members and generally equally spaced therefrom but extending beyond said elongated member;

a simulated cow's head mounted at said apex;

a simulated rear cow portion mounted at the terminal end of said bar and rotatable thereabout;

a pair of spaced elliptically shaped interconnected wheels mounted between said elongated members adjacent said upright members and interconnected thereto for rotation with respect thereto, the point of interconnection of said wheels together being offset from the point of connection of said wheels to said upright members; and linkage means interconnecting said wheels and said rear cow portion so that said rear cow portion moves back and forth when said dummy is towed along a supporting surface and said wheels rotate on said supporting surface, said forward end of said dummy moving up and down with respect to said supporting surface when said dummy is towed therealong.

2. In the dummy of claim 1 wherein said cow's head includes a first elongated member extending up and down from said apex and angled with respect thereto, a cross bar fixed to said first elongated cow's member at substantially its midpoint thereof, and a pair of second and third elongated members fixed to the respective free ends of said cross bar and extending outwardly and upwardly at an angle therefrom.

3. In the dummy of claim 1 wherein said rear cow portion includes an A-shaped frame having the cross-bar of said A pivotally connected to the terminal end of said bar at substantially its midpoint thereof, said linkage means being connected to the apex of said A-shaped frame about the cross-bar thereof with the legs of said A-shaped frame extending downwardly from said cross-bar thereof.

4. In the dummy of claim 3 wherein said legs of said A-shaped frame include a pair of spaced elongated members having angled portions at the bottom respective ends thereof angled inwardly toward the head of said dummy.

5. In the dummy of claim 1 wherein said wheels are joined by an axle and said linkage means includes a link interconnecting said axle and said rear cow portion.

6. In the dummy of claim 5 wherein said link includes a bend therein between said axle and said rear cow portion.

7. In the dummy of claim 5 wherein said axle is joined to said wheels at a point offset from the center thereof.

8. In the dummy of claim 7 wherein said wheels are coupled to said upright members by a pair of L-shaped tubes having a first short section connected to said wheels and second larger sections interconnected to a cross-bar interconnecting the lower ends of said upright members.

9. In the dummy of claim 8 wherein said last mentioned cross-bar includes a tie rod thereon for tethering a rope or the like thereto.

10. In the dummy of claim 1 including a plurality of spaced lugs on the outer peripheries of said wheels engaging a supporting surface when said dummy is towed therealong.

11. In the dummy of claim 1 including a plurality of hand hold brackets at spaced locations along said elongated members.

12. In the dummy of claim 1 including a pair of support members interconnecting said elongated members to said bar between said cow's head and said rear cow portion.

13. In the dummy of claim 1 wherein said wheels are interconnected by an axle fixedly secured to the inner faces of said wheels and said wheels are rotatably connected to said upright members by elongated L-shaped rods having short portions rotatably secured to the outer respective faces of said wheels and spaced from the point of connection of said axle, and longer portions extending normal from said short portions rotatably secured to said upright members.

* * * * *